US006459384B1

(12) United States Patent
Wahlin

(10) Patent No.: US 6,459,384 B1
(45) Date of Patent: Oct. 1, 2002

(54) ILLUMINATION AND GUIDANCE SYSTEM FOR TRAFFIC AREAS

(75) Inventor: Ramon Wahlin, Borlange (SE)

(73) Assignee: Visual Guidance Systems Scandinavia AB, Borlange (SE)

( * ) Notice: Subject to any disclaimer, the term of this patent is extended or adjusted under 35 U.S.C. 154(b) by 0 days.

(21) Appl. No.: 09/700,798

(22) PCT Filed: May 20, 1999

(86) PCT No.: PCT/SE99/00863

§ 371 (c)(1),
(2), (4) Date: Jan. 2, 2001

(87) PCT Pub. No.: WO99/63265

PCT Pub. Date: Dec. 9, 1999

(30) Foreign Application Priority Data

May 20, 1998 (SE) ..... 9801792

(51) Int. Cl.[7] ..... G08G 1/095

(52) U.S. Cl. ..... 340/907; 340/932; 362/431; 362/153.1

(58) Field of Search ..... 340/907, 908, 340/908.1, 932, 932.1, 905; 362/431, 416, 153.1; 313/493, 634

(56) References Cited

U.S. PATENT DOCUMENTS

| | | | | |
|---|---|---|---|---|
| 5,343,374 A | | 8/1994 | Gordin et al. | 362/153.1 |
| 5,575,550 A | * | 11/1996 | Appeldorn et al. | 362/32 |
| 5,606,815 A | | 3/1997 | Feldwhere | 40/607 |
| 5,680,121 A | * | 10/1997 | Shiozaki et al. | 340/908.1 |

FOREIGN PATENT DOCUMENTS

| | | |
|---|---|---|
| FR | 2 625 018 | 6/1989 |
| FR | 2 630 848 | 11/1989 |
| SE | 336 995 | 7/1971 |
| WO | WO 91/09253 | 6/1991 |

* cited by examiner

*Primary Examiner*—Jeffery Hofsass
*Assistant Examiner*—Son Tang
(74) *Attorney, Agent, or Firm*—Young & Thompson

(57) ABSTRACT

A road lamp for illuminating roads, streets, and thoroughfares, to be suspended over or adjacent a road, street, or thoroughfare. The lamp is also designed to provide information relating to the direction of the road, street, or thoroughfare, and to any special traffic environments to be observed.

6 Claims, 4 Drawing Sheets

ILLUMINATION AND GUIDANCE SYSTEM FOR TRAFFIC AREAS

This application is A 371 of PCT/SE99/00863 May 20, 1999.

FIELD OF THE INVENTION

The present invention pertains to the compilation of a constructed "language" concerning a signifying visual guidance system for use with traffic environments.

BACKGROUND OF THE INVENTION

In the construction of road illuminating lamps, attention has been primarily directed towards designing the lamps so that the road concerned will be effectively illuminated to the best possible extent, such that energy and maintenance costs can be kept as low as possible, while the poles or posts carrying the lamps are designed to cause as little damage as possible in the event of a vehicle colliding with a lamp post, or to provide a lamp post that has a particularly attractive architectural appearance.

The present invention is directed more specifically to the information that can be given to a road user, for example through the medium of road lamps, lamp posts, etc., and not solely by illumination of the road or street. If the road user is able to glean further information concerning the manner in which the road space continues through the configuration of the lamp or the lamp post, then this can only lead to improved traffic safety.

The invention is accordingly based on the concept of a semiotic method of clarifying street and road sections based on the systematic of utilising the non-verbal sign systems "lamp language", "colour language" and "post language" to clarify traffic space and therewith enhance traffic safety.

The distinguishing features utilised in the significative expressions may, for instance, be the lamp (its design, placement, the numbers in which it is present, etc.), the colour of the light and the lamp posts or poles (their form, length, colour, construction, and possibly supplementary "signals").

OBJECTS OF THE INVENTION

Accordingly, one object of the present invention is to provide An illuminating and guidance system for traffic environments, in which lamp posts and/or lamps are designed so that they can also provide information about the extension of the road and also particular traffic environments that the road user should be aware of.

Another object of the present invention is to provide a road lamp which will provide optical guidance through the medium of the significative illuminating lamp in addition to illuminating the extension of the roadway and possibly also particularly critical points in the traffic environment.

BRIEF DESCRIPTION OF THE DRAWINGS

The invention will now be described with reference to a couple of non-limiting embodiments thereof in the form of road illuminating lamps and with reference to the accompanying drawings, in which.

DETAILED DESCRIPTION OF THE INVENTION

Figure 1:
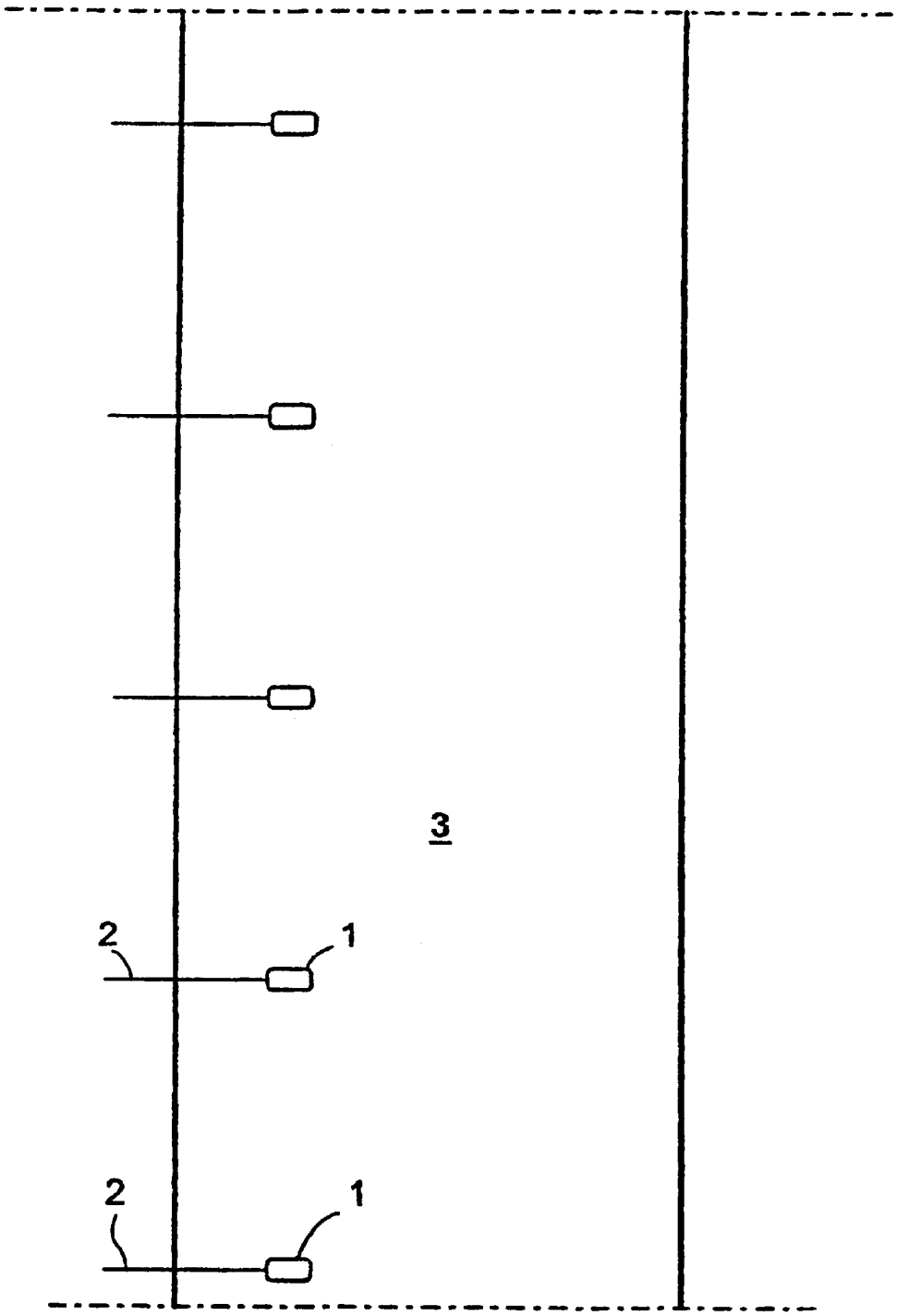
FIG. 1 illustrates schematically typical road lighting.

FIG. 1 thus shows a traditional road lamp 1 mounted on a lamp post 2 which curves in over the roadway 3. The lamp 1 is generally punctiform whereas its reflector may be constructed to spread light laterally away from the post 2, so as to illuminate the road 3 to a greater extent in its longitudinal direction. Although the lamp 1 may have different forms, its light source can nevertheless be considered to be punctiform in respect of those road lamps at present available.

Figure 2:
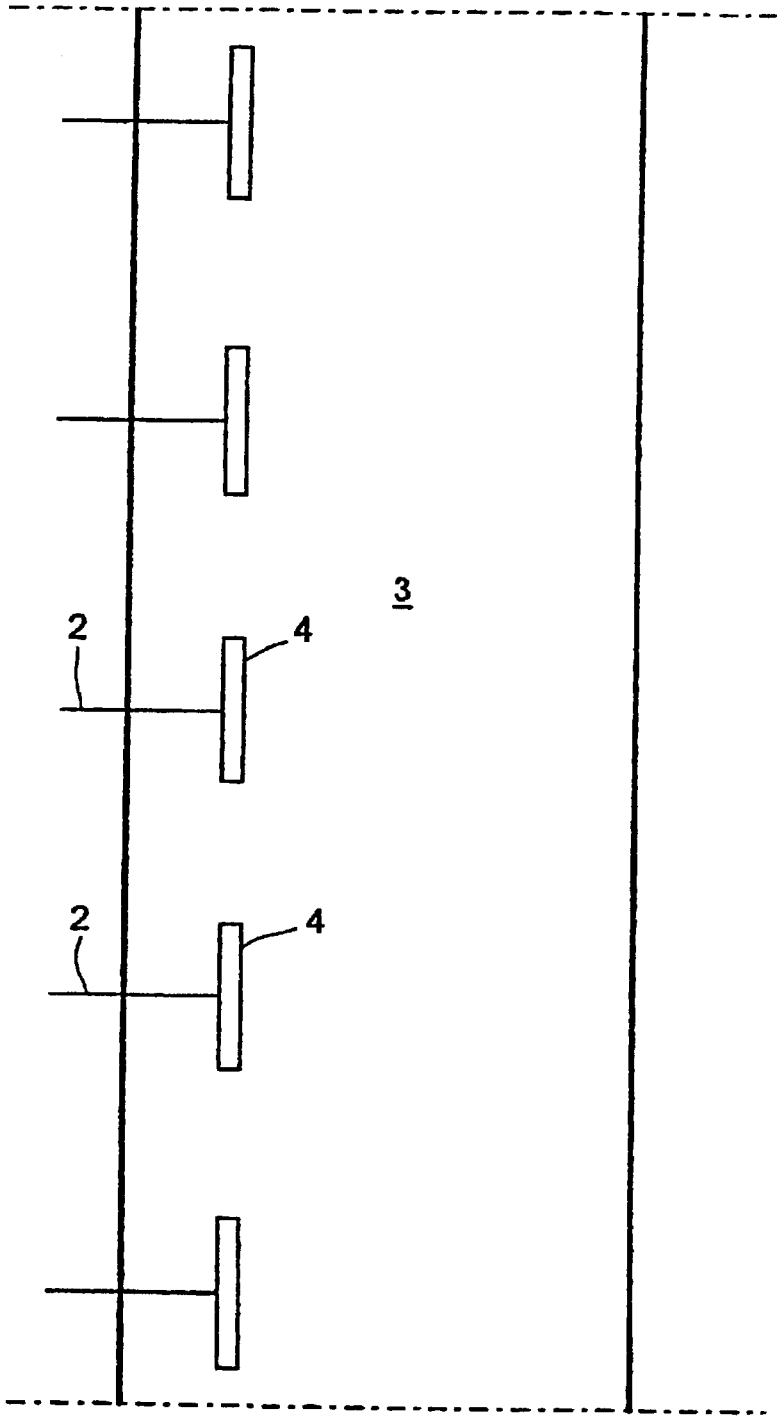
FIG. 2 is a view corresponding to FIG. 1 but showing road lamps constructed in accordance with the invention.

FIG. 2 illustrates an inventive road lamp 4 which distinct from being punctiform as in FIG. 1 is elongated with a length extension in the longitudinal direction of the road 3. The lamp 4 includes at least one illuminating unit that may have any appropriate type of light source whatsoever, such as for instance mercury, high-pressure sodium, low pressure sodium and metal halogen. So as to spread the light correctly, the lamp 4 is provided typically with a reflector or refractor which distributes the light from the light source in a desired manner, so as to illuminate the road 3 in the manner intended. The lamp may also as known be mounted either directly on a lamp post 2 or on a wire suspended between two posts and/or roads.

Because the inventive road lamp 4 is elongated and extends in the longitudinal direction of the roadway 3, there is also obtained a visual marking high above the surface of the road of its continued extension. This visual marking enables the road user to discern the continuation of the road much more easily, wherewith he or she will register in his or her mind how the road will continue more or less subconsciously and be able to concentrate more on the environment in his/her immediate proximity while still being prepared for changes in the road ahead.

Figure 3:
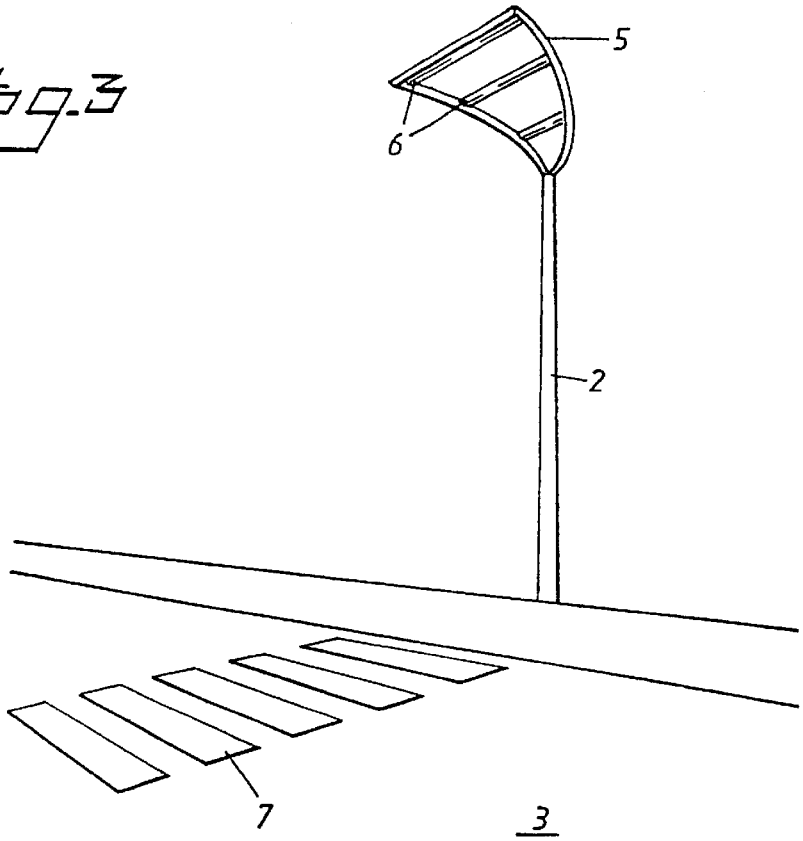
FIG. 3 is a schematic, perspective view of an inventive road lamp positioned at a pedestrian crossing.

FIG. 3 illustrates how an inventive road lamp can be configured to provide information concerning the presence of a pedestrian crossing. The road lamp S has the form of an arm fitted on top of a post 2 and extending over the road 3. The lamp includes a plurality of illuminating units 6 which extend parallel with one another in the longitudinal direction of the road. The road illuminating units 6 are positioned in a pattern corresponding to the pedestrian crossing markings 7 painted on the surface of the road 3, and consequently road users will be warned of the presence of a pedestrian crossing in addition to the lamp illuminating said crossing 7 in a more concentrated manner. The road user thus becomes aware of the presence of the crossing much earlier than would otherwise be the case, and is able to adapt his driving approach to the crossing in good time.

Figure 4:
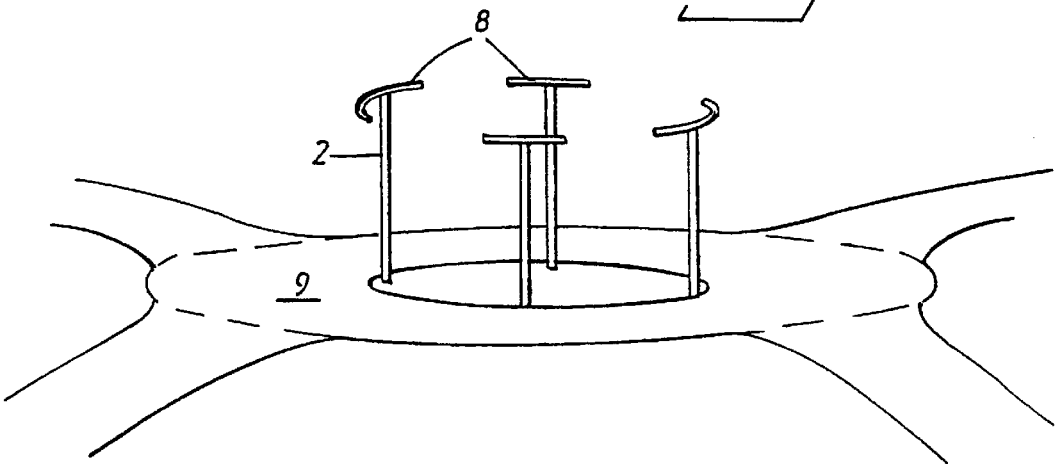
FIG. 4 is a perspective view of an inventive road lamp used in a traffic roundabout.

In the case of other special traffic environments, such as a traffic roundabout for instance, the inventive lamp may have the form shown in FIG. 4. The illustrated lamps 8 are mounted on respective posts 2 in the centre of the traffic roundabout 9 and are arcuate in shape, suitably with a radius of curvature that corresponds at least approximately to the centre of the roundabout. In the illustrated case, each lamp 8 is mounted on its respective post 2, although it will be understood that the lamps may comprise several mutually connected lamps which form a circle and which will mark the roundabout very effectively when switched on and enable the roundabout to be seen from far away. It may be suitable to place lamps both in the centre of the roundabout and around its outer periphery, at least in the case of large traffic roundabouts.

Figure 5:
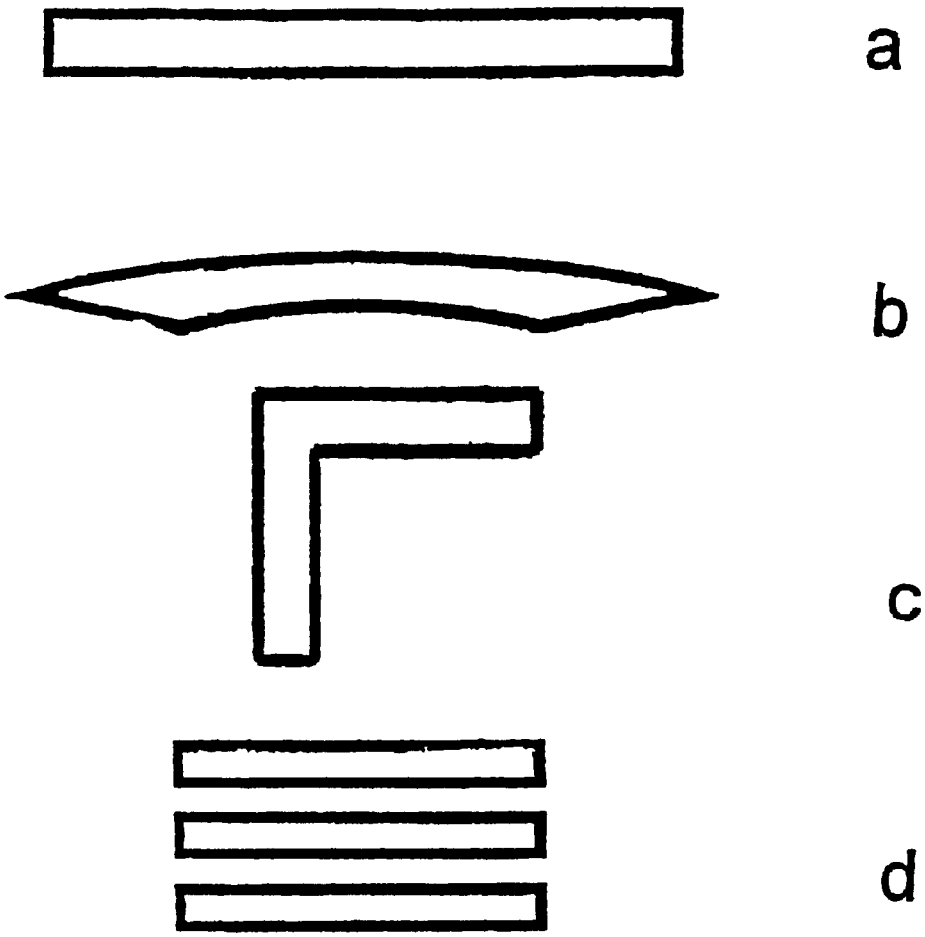
FIG. 5 is a schematic illustrating of inventive road lamps intended for different traffic environments.

As before mentioned, the road lamps according to the invention may have different designs for different traffic environments, wherewith the common feature of said lamps is that they are elongated and parallel with the road direction and have, in this way, the significance of being clear and visible from a long distance and are able to illuminate a continued extension of the road. For example, the reference a in FIG. 5 identifies the general design of a road lamp which is intended to illuminate a straight section of the road, the reference b corresponds to a small traffic roundabout, the reference c identifies the design of a lamp intended for a small crossing, and d identifies the general design of a road illuminating lamp intended to be placed adjacent to, over, a pedestrian crossing. Also conceivable are designs for special road illuminating lamps for other types of traffic environments within the scope of the invention, for instance lamp designs which indicate other types of road crossings, stop signs, etc.

All of the different types of road illuminating lamps according to the invention can be provided with any suitable type of illuminating unit, light source and reflector/refractor, as mentioned above in conjunction with the description of FIG. 2.

Designing of road illuminating lamps in accordance with the invention affords the aforesaid further object of the lamp, namely that of providing the road user with further information concerning the nature of the road space, so that he will be able to adapt his driving more easily and therewith improve traffic safety. The placement of the lamps causes the road user to register the information given by the lamps without consciously thinking about the actual information imparted by the lamps but, nevertheless, absorbing the information subconsciously so as to influence his actions.

It will be understood that the inventive road illuminating lamps can be designed in other ways than those described above without departing from the scope of the invention.

As mentioned earlier, the invention is not restricted solely to road illuminating lamps but also embraces other devices that may be of significance to the road user. Analogously to the design of road illuminating lamps, also the posts, for example, that support lamps or signs may themselves be designed to impart information concerning a change in the traffic environment, for instance that the road user is approaching a curve, a pedestrian crossing, a road crossing, an exit, a bus stop or the like. Correspondingly, the colour of the light may be varied to suit different points in the traffic environment. For instance, different colours may give indications of different types of behaviour in the traffic environment, for instance that the light emitted at crossings or at bus stops may have a colour different to the light emitted by a lamp in other respects. An essential part of the invention is that the objects to be placed out in the road space are designed consistently, so that they will also impart information relating to the continuing extension of the road space. Especially, in accordance with the invention, such devices will be disposed at a height above the road surface that will enable them to be seen a long way away by a road user, who can then adjust his driving in accordance with the information imparted by said devices.

The design of road illuminating lamps in accordance with the example above is such as to provide the additional information desired in the absence of any training, since the significance of the information is purely natural. Although the significance is not equally as natural with respect to the colour of the light emitted by the lamps and the design of the lamp posts, the road user will nevertheless be aware of a change in the traffic environment without needing to be trained in this respect. However, consistent use of colour applications and consistent lamp post designs will instil their significance in the mind of the road user and the purport of the information will become apparent in the passage of time.

What is claimed is:

1. A road lamp for illuminating roads, streets, and thoroughfares, to be suspended over or adjacent a road, street, or thoroughfare, wherein the lamp is also designed to provide information relating to the direction of the road, street, or thoroughfare, and to any special traffic environments to be observed.

2. A road lamp as claimed in claim 1, wherein the lamp is an illuminating unit that extends in a longitudinal direction of the road, street, or thoroughfare.

3. A road lamp according to claim 2, wherein the lamp is comprised of several mutually parallel illuminating units and is used at a pedestrian crossing.

4. A road lamp according to claim 1, wherein the lamp is arcuate in shape with an arc corresponding to the curvature of a traffic roundabout, and is used at a traffic roundabout.

5. A road lamp according to claim 4, wherein the lamp is mounted in the center of the traffic roundabout.

6. A road lamp according to claim 1, wherein the lamp is arcuate in shape with an arc corresponding to the curvature of a traffic roundabout, and is used at a traffic roundabout.

* * * * *